US010435857B1

(12) United States Patent
Michlig

(10) Patent No.: US 10,435,857 B1
(45) Date of Patent: Oct. 8, 2019

(54) FROST HEAVE PREVENTION SYSTEM

(71) Applicant: Mary Michlig, Edgar, WI (US)

(72) Inventor: Mary Michlig, Edgar, WI (US)

( * ) Notice: Subject to any disclaimer, the term of this patent is extended or adjusted under 35 U.S.C. 154(b) by 0 days.

(21) Appl. No.: 16/278,898

(22) Filed: Feb. 19, 2019

(51) Int. Cl.
*E02D 5/60* (2006.01)
*E02D 5/22* (2006.01)
*E02D 5/52* (2006.01)
*E02D 5/24* (2006.01)

(52) U.S. Cl.
CPC ..... *E02D 5/226* (2013.01); *E02D 5/24* (2013.01); *E02D 5/523* (2013.01); *E02D 5/60* (2013.01); *E02D 2200/1635* (2013.01); *E02D 2200/1642* (2013.01); *E02D 2300/002* (2013.01)

(58) Field of Classification Search
CPC .. E02D 5/226; E02D 5/24; E02D 5/60; E02D 2200/1635; E02D 2200/1642; E02D 2300/002; D02D 5/523
See application file for complete search history.

(56) References Cited

U.S. PATENT DOCUMENTS 87,015 A 2/1869 Samuel
3,630,037 A * 12/1971 Howard ..... E02D 5/226 405/231
4,019,301 A * 4/1977 Fox ..... E02D 5/60 405/216
4,585,681 A 4/1986 Kidera
4,721,418 A * 1/1988 Queen ..... E02D 31/10 405/231
D298,276 S 10/1988 Butcher
4,818,148 A 4/1989 Takeda
6,167,672 B1 * 1/2001 Okitomo ..... E02D 5/60 405/216
6,793,443 B2 9/2004 Larsen, Jr.
7,300,228 B2 * 11/2007 Colbert ..... E02D 31/12 405/216
8,690,482 B2 * 4/2014 Fey ..... E02D 5/64 405/211
8,833,020 B2 9/2014 Oliver
9,523,177 B2 12/2016 Snethun
9,903,086 B2 * 2/2018 Queen ..... E02D 5/60

* cited by examiner

*Primary Examiner* — Benjamin F Fiorello

(57) ABSTRACT

The frost heave prevention system is configured for use with a piling. The piling further comprises a stanchion and a frost pad. The stanchion anchors to the frost pad. The frost pad is a concrete pad that is buried below the frost line such that frost will not cause the frost pad and the stanchion to heave or otherwise shift. The frost heave prevention system comprises a skirt structure and the piling. The skirt structure encloses the piling such that the skirt structure inhibits water from flowing towards the anchor joint between the stanchion and the frost pad thereby inhibiting a common source of failure when using a frost pad.

11 Claims, 5 Drawing Sheets

FROST HEAVE PREVENTION SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of engineering in general including engineering and construction elements in general, more specifically, sheets/panels and members of similar proportions.

SUMMARY OF INVENTION

The frost heave prevention system is configured for use with a piling. The piling further comprises a stanchion and a frost pad. The stanchion anchors to the frost pad. The frost pad is a concrete pad that is buried below the frost line such that frost will not cause the frost pad and the stanchion to heave or otherwise shift. The frost heave or otherwise shift prevention system comprises a skirt structure and the piling. The skirt structure encloses the piling such that the skirt structure inhibits water from flowing towards the anchor joint between the stanchion and the frost pad thereby inhibiting a common source of failure when using a frost pad.

These together with additional objects, features and advantages of the frost heave prevention system will be readily apparent to those of ordinary skill in the art upon reading the following detailed description of the presently preferred, but nonetheless illustrative, embodiments when taken in conjunction with the accompanying drawings.

In this respect, before explaining the current embodiments of the frost heave prevention system in detail, it is to be understood that the frost heave prevention system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the frost heave prevention system.

It is therefore important that the claims be regarded as including such equivalent construction insofar as they do not depart from the spirit and scope of the frost heave prevention system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
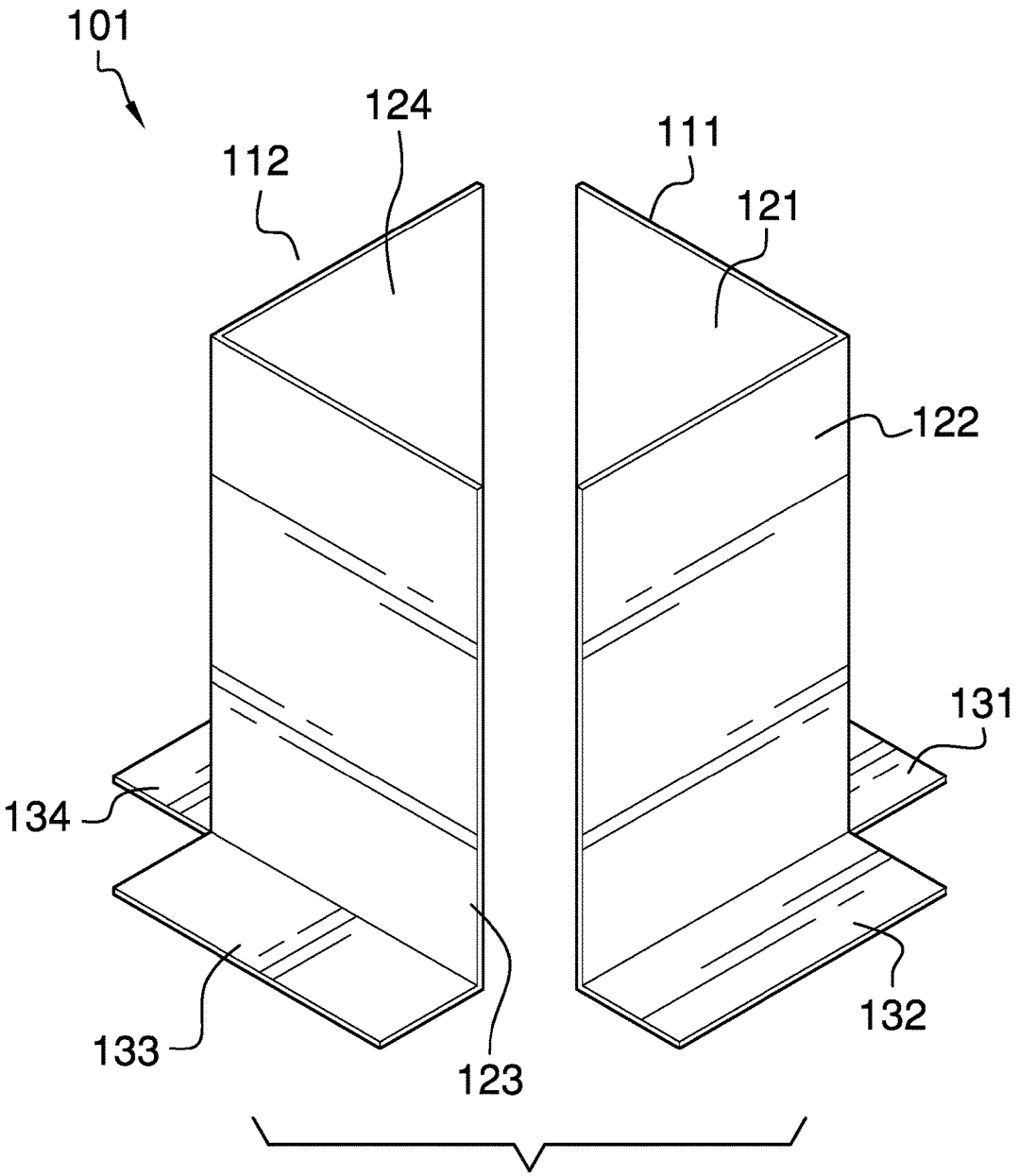
FIG. 1 is a perspective view of an embodiment of the disclosure.
Figure 2:
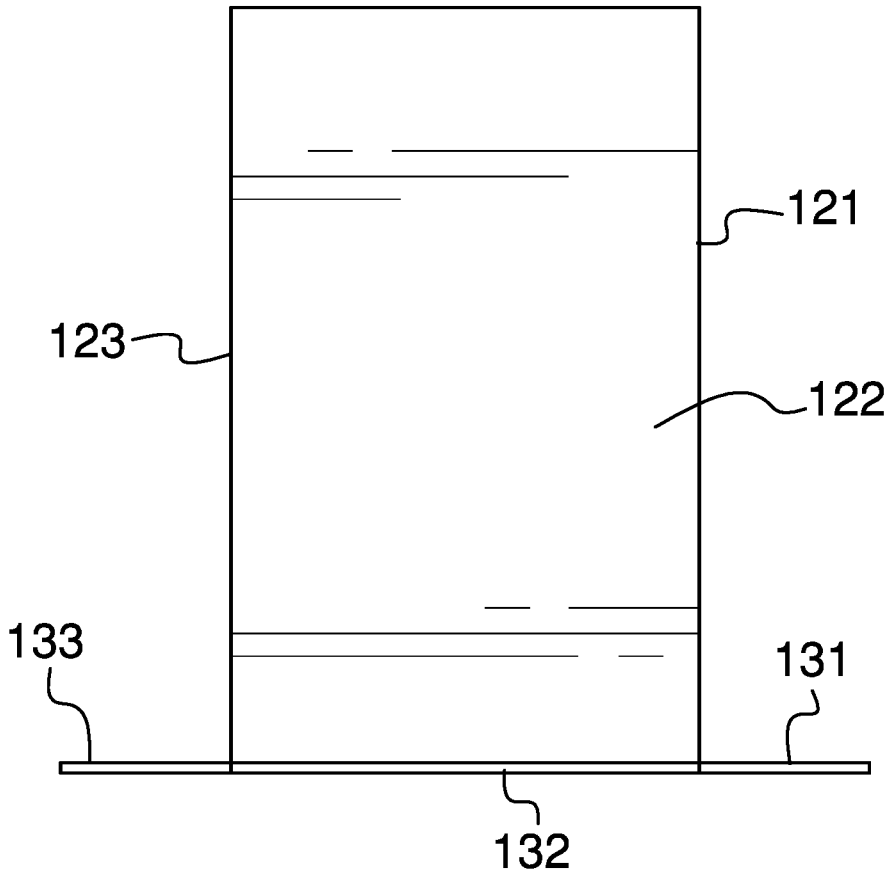
FIG. 2 is a front view of an embodiment of the disclosure.
Figure 3:
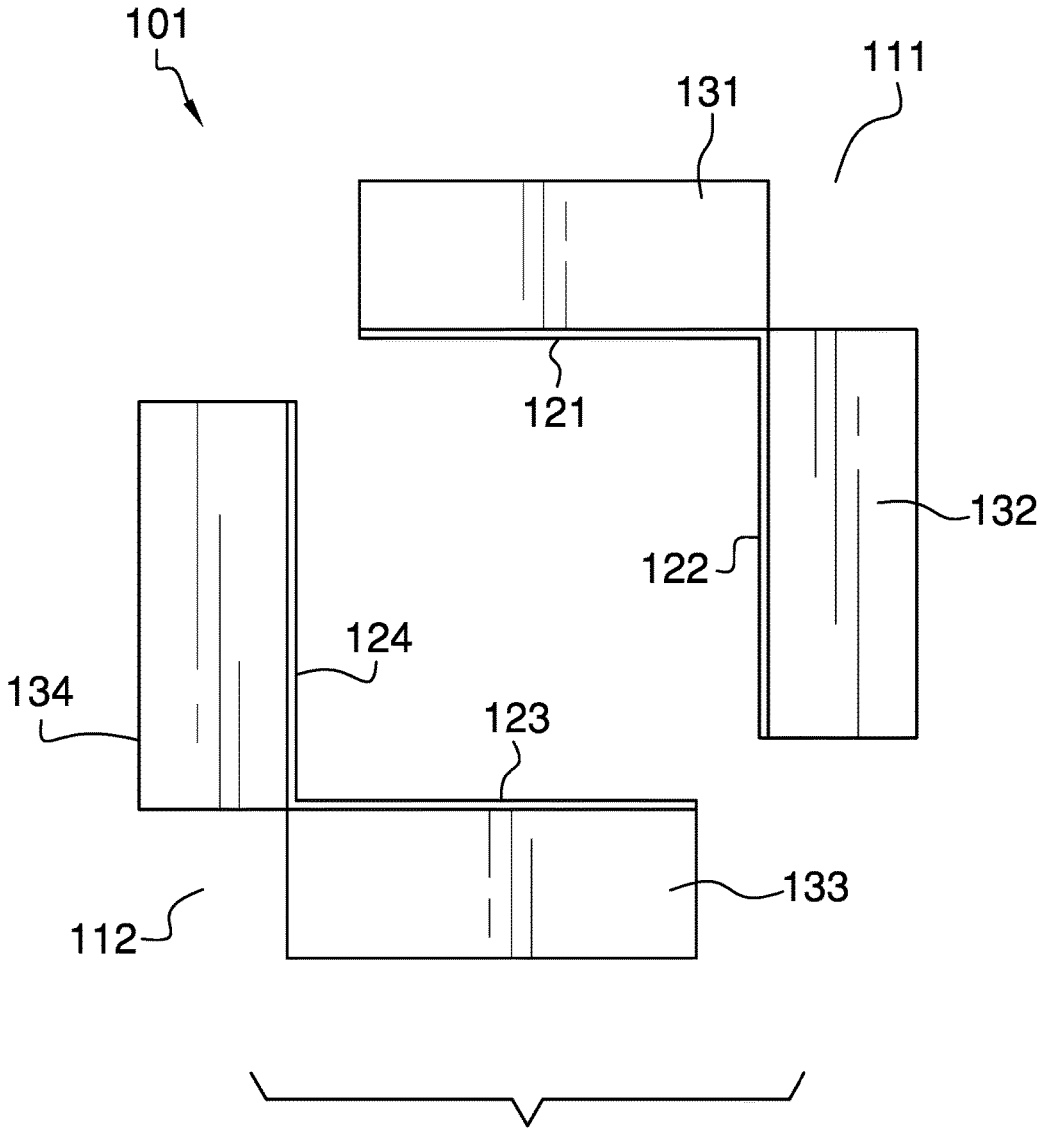
FIG. 3 is a top view of an embodiment of the disclosure.
Figure 4:
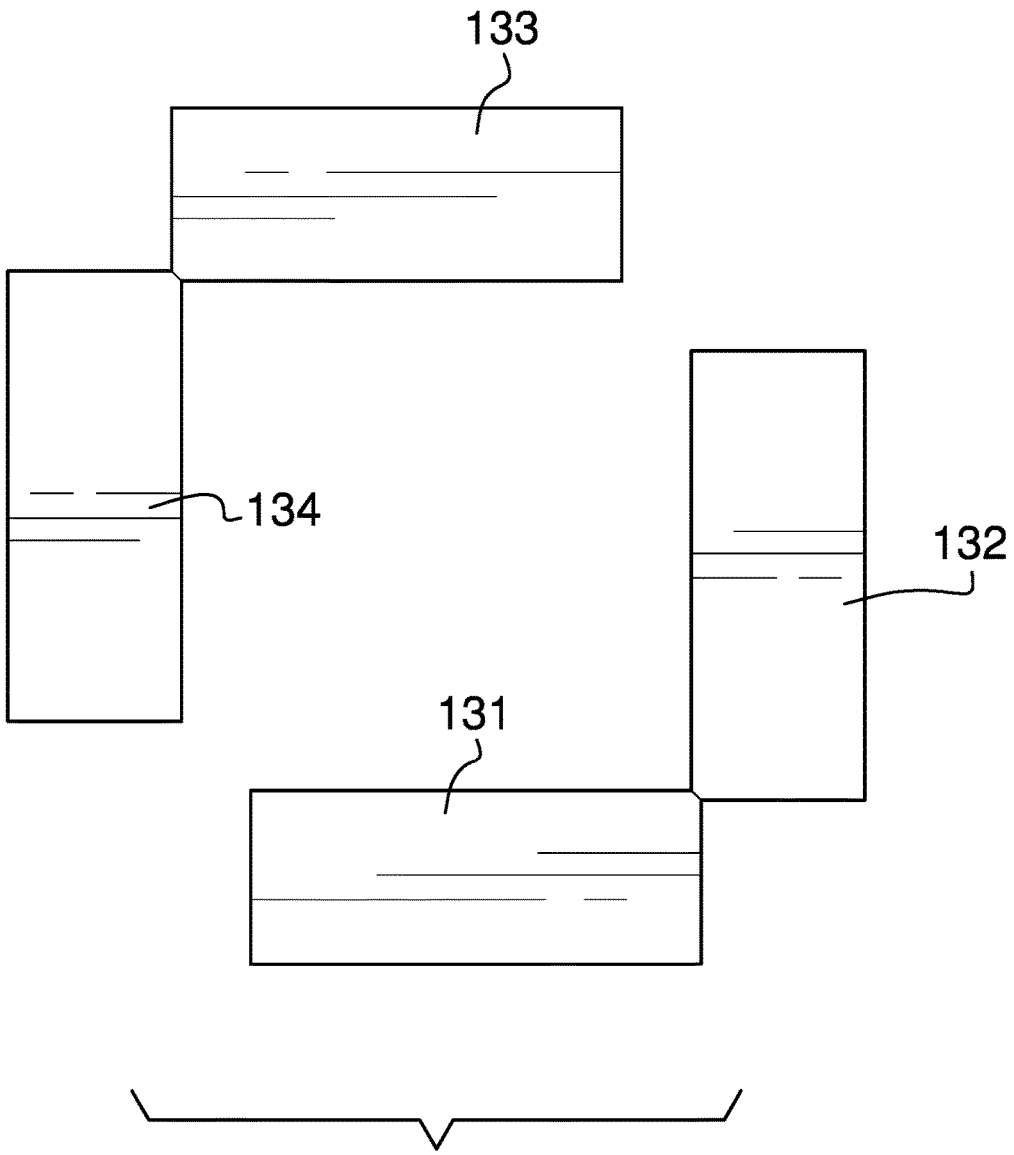
FIG. 4 is a bottom view of an embodiment of the disclosure.
Figure 5:
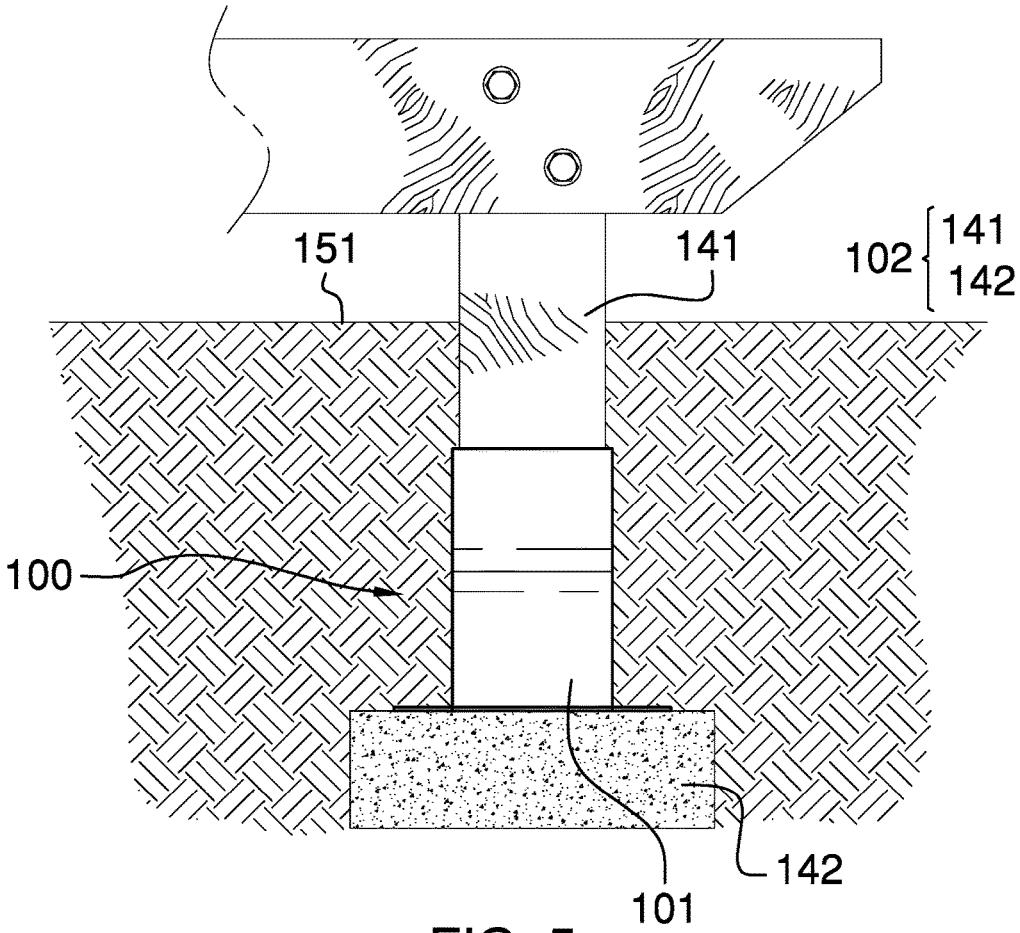
FIG. 5 is an in-use view of an embodiment of the disclosure.

Detailed reference will now be made to one or more potential embodiments of the disclosure, which are illustrated in FIGS. 1 through 5.

The frost prevention system 100 (hereinafter invention) is configured for use with a piling 102. The piling 102 further comprises a stanchion 141 and a frost pad 142. The stanchion 141 anchors to the frost pad 142. The frost pad 142 is a concrete pad that is buried below the frost line such that frost will not cause the frost pad 142 and the stanchion 141 to heave or otherwise shift. The invention 100 comprises a skirt structure 101 and the piling 102. The skirt structure 101 encloses the piling 102 such that the skirt structure 101 inhibits water from flowing towards the anchoring joint between the stanchion 141 and the frost pad 142 thereby inhibiting a common source of failure when using a frost pad 142.

The piling 102 is a vertically oriented structure forms a load path for a load that is raised above the supporting surface to which the piling 102 is secured. The piling 102 is driven into the ground 151. The piling 102 comprises a stanchion 141 and a frost pad 142.

The stanchion 141 is a prism-shaped load-bearing structure. The stanchion 141 is sunk into the ground 151 such that the stanchion 141 forms a load path that transfers a load raised above the ground 151 by the stanchion 141 into the ground 151.

The frost pad 142 is a concrete pad. The frost pad 142 is a prism-shaped structure. The frost pad 142 is buried in the ground 151 below the frost line. By frost line is meant a reference depth below the ground 151 below which the ground 151 will not freeze.

The stanchion 141 rests directly on the frost pad 142 such that the stanchion 141 and the frost pad 142 are not subject to frost heave. The skirt structure 101 forms a protective barrier around the stanchion 141 and the frost pad 142 such that the stanchion 141 and the frost pad 142 are protected from the ground 151 fill.

The skirt structure 101 is a prism-shaped tubular structure. The skirt structure 101 is formed with a flange. The skirt structure 101 is geometrically similar to the stanchion 141 such that the tubular structure of the skirt structure 101 wraps around the stanchion 141. The flange elements of the skirt structure 101 rest on the superior surface of the frost pad 142 such that the skirt structure 101 encloses the anchor joint formed between the stanchion 141 and the frost pad 142 of the piling 102. The skirt structure 101 comprises a first skirt panel 111 and a second skirt panel 112.

The first skirt panel 111 is a three-dimensional structure. The first skirt panel 111 is formed from a plurality of disk-shaped plates. The first skirt panel 111 forms a first portion of the skirt structure 101 that encloses the stanchion 141. The first skirt panel 111 forms a first portion of the flange of the skirt structure 101 that rests on the frost pad 142. The first skirt panel 111 comprises a first vertical plate 121, a second vertical plate 122, a first horizontal plate 131, and a second horizontal plate 132.

The second skirt panel 112 is a three-dimensional structure. The second skirt panel 112 is formed from a plurality of disk-shaped plates. The second skirt panel 112 forms the balance of the skirt structure 101 that encloses the stanchion 141. The second skirt panel 112 forms the balance of the flange of the skirt structure 101 that rests on the frost pad 142. The second skirt panel 112 comprises a third vertical plate 123, a fourth vertical plate 124, a third horizontal plate 133, and a fourth horizontal plate 134.

The second skirt panel 112 is placed against the first skirt panel 111 to form the tubular structure of the skirt structure 101 that encloses the stanchion 141. The second skirt panel 112 is placed against the first skirt panel 111 to form the flange structure of the skirt structure 101 that rests on the frost pad 142. The first skirt panel 111 is in contact with but not directly attached to the stanchion 141. The first skirt panel 111 is in contact with but not directly attached to the frost pad 142. The second skirt panel 112 is in contact with but not directly attached to the stanchion 141. The second skirt panel 112 is in contact with but not directly attached to the frost pad 142. The first skirt panel 111 is in contact with but not directly attached to the second skirt panel 112.

Optionally, an end user may use a piece of tape, zip tie, or other item (not depicted) to temporarily secure the first skirt panel 111 and the second skirt panel 112 in place around the stanchion 141. Use of the piece of tape (not depicted) provides a temporary securement of the invention 100 such that when the hole is back filled, loose dirt does not cause the first skirt panel 111 or the second skirt panel 112 to shift.

The first skirt panel 111 and the second skirt panel 112 are held in position relative to stanchion 141 by the ground 151 fill surrounding the piling 102. The first skirt panel 111 and the second skirt panel 112 are held in position relative to each other by the ground 151 fill surrounding the piling 102.

The first vertical plate 121 is a rectangular disk structure. The first vertical plate 121 is a vertically oriented structure that encloses a portion of the stanchion 141 of the piling 102. The second vertical plate 122 is a rectangular disk structure. The form factor of the second vertical plate 122 is identical to the form factor of the first vertical plate 121. The second vertical plate 122 is a vertically oriented structure that encloses a portion of the stanchion 141 of the piling 102. The second vertical plate 122 attaches to the first vertical plate 121 such that the second vertical plate 122 projects perpendicularly away from the first vertical plate 121.

The third vertical plate 123 is a rectangular disk structure. The form factor of the third vertical plate 123 is identical to the form factor of the second vertical plate 122. The third vertical plate 123 is a vertically oriented structure that encloses a portion of the stanchion 141 of the piling 102. The fourth vertical plate 124 is a rectangular disk structure. The form factor of the fourth vertical plate 124 is identical to the form factor of the third vertical plate 123. The fourth vertical plate 124 is a vertically oriented structure that encloses a portion of the stanchion 141 of the piling 102. The fourth vertical plate 124 attaches to the first vertical plate 121 such that the fourth vertical plate 124 projects perpendicularly away from the first vertical plate 121. The third vertical plate 123 attaches to the second vertical plate such that the third vertical plate 123 projects perpendicularly away from the second vertical plate 122.

The first horizontal plate 131 is a rectangular disk structure. The first horizontal plate 131 is a horizontally oriented structure that rests on the superior surface of the frost pad 142 of the piling 102. The first horizontal plate 131 attaches to the first vertical plate 121 such that the first horizontal plate 131 projects perpendicularly away from the first vertical plate 121 and the second vertical plate 122. The second horizontal plate 132 is a rectangular disk structure. The form factor of the second horizontal plate 132 is identical to the form factor of the first horizontal plate 131. The second horizontal plate 132 is a horizontally oriented structure that rests on the superior surface of the frost pad 142 of the piling 102. The second horizontal plate 132 attaches to the second vertical plate 122 such that the second horizontal plate 132 projects perpendicularly away from the second vertical plate 122 and the first vertical plate 121.

The third horizontal plate 133 is a rectangular disk structure. The form factor of the third horizontal plate 133 is identical to the form factor of the second horizontal plate 132. The third horizontal plate 133 is a horizontally oriented structure that rests on the superior surface of the frost pad 142 of the piling 102. The third horizontal plate 133 attaches to the third vertical plate 123 such that the third horizontal plate 133 projects perpendicularly away from the third vertical plate 123 and the fourth vertical plate 124. The fourth horizontal plate 134 is a rectangular disk structure. The form factor of the fourth horizontal plate 134 is identical to the form factor of the third horizontal plate 133. The fourth horizontal plate 134 is a horizontally oriented structure that rests on the superior surface of the frost pad 142 of the piling 102. The fourth horizontal plate 134 attaches to the fourth vertical plate 124 such that the fourth horizontal plate 134 projects perpendicularly away from the fourth vertical plate 124 and the third vertical plate 123.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Flange: As used in this disclosure, a flange is a protruding rib, edge, or collar that is used to hold an object in place or to attach a first object to a second object.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Forward: As used in this disclosure, forward is a term that relates a first object to a second object. When the first object is closer to the bow of a vehicle, the first object is said to be forward of the second object. The term is commonly used on vessels and vehicles. See bow, aft, port, starboard, and stern Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Ground: As used in this disclosure, the ground is a solid supporting surface formed by the Earth. The term level ground means that the supporting surface formed by the ground is roughly perpendicular to the force of gravity.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Piling: As used in this disclosure, a piling is a stanchion that forms the foundation of a larger structure.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular appearance. Plates often have a disk-like structure. The face of the plate is a surface of the plate selected from the group consisting of: a) the surface of the plate with the greatest surface area; b) the surface of the plate that is distal from the surface of the plate with the greatest surface area. The edges of the plate comprise the surfaces of the plate that would not be considered faces as defined above. As defined in this disclosure, plates may be made of any material, but are commonly made of metal, plastic, and wood. When made of wood, a plate is often referred to as a board or a plank.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Stanchion: As used in this disclosure, a stanchion refers to a vertical pole, post, or support.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A structure to inhibit frost heave comprising:

a skirt structure and a piling;

wherein the skirt structure is configured for use with the piling;

wherein the skirt structure encloses the piling;

wherein the skirt structure is a prism-shaped tubular structure;

wherein the skirt structure is formed with a flange;

wherein the piling is a vertically oriented structure forms a load path;

wherein the piling comprises a stanchion and a frost pad;

wherein the stanchion anchors to the frost pad;

wherein the frost pad is a concrete pad that is buried below a frost line;

wherein the skirt structure encloses the piling such that the skirt structure forms a barrier around the anchoring joint between the stanchion and the frost pad;

wherein the stanchion is a prism-shaped load-bearing structure;

wherein the stanchion is sunk into the ground such that the forms a load path;

wherein the frost pad is a concrete pad;

wherein the frost pad is a prism-shaped structure;

wherein the frost pad is buried in the ground below the frost line;

wherein the stanchion rests directly on the frost pad such that the stanchion and the frost pad are not subject to frost heave;

wherein the skirt structure forms a protective barrier around the stanchion and the frost pad;

wherein the skirt structure is geometrically similar to the stanchion such that the tubular structure of the skirt structure wraps around the stanchion;

wherein the flange elements of the skirt structure rest on the superior surface of the frost pad such that the skirt structure encloses the anchor joint formed between the stanchion and the frost pad of the piling.

2. The structure to inhibit frost heave according to claim 1 wherein the skirt structure comprises a first skirt panel and a second skirt panel;

wherein the first skirt panel is a three-dimensional structure;

wherein the first skirt panel forms a first portion of the skirt structure that encloses the stanchion;

wherein the first skirt panel forms a first portion of the flange of the skirt structure that rests on the frost pad;

wherein the second skirt panel is a three-dimensional structure;

wherein the second skirt panel forms the balance of the skirt structure that encloses the stanchion;

wherein the second skirt panel forms the balance of the flange of the skirt structure that rests on the frost pad.

3. The structure to inhibit frost heave according to claim 2 wherein the first skirt panel is formed from a plurality of disk-shaped plates;

wherein the second skirt panel is formed from a plurality of disk-shaped plates.

4. The structure to inhibit frost heave according to claim 3 wherein the second skirt panel is placed against the first skirt panel to form the tubular structure of the skirt structure that encloses the stanchion;

wherein the second skirt panel is placed against the first skirt panel to form the flange structure of the skirt structure that rests on the frost pad.

5. The structure to inhibit frost heave according to claim 4 wherein the first skirt panel is in contact with but not directly attached to the stanchion;

wherein the first skirt panel is in contact with but not directly attached to the frost pad;

wherein the second skirt panel is in contact with but not directly attached to the stanchion;

wherein the second skirt panel is in contact with but not directly attached to the frost pad;

wherein the first skirt panel is in contact with but not directly attached to the second skirt panel.

6. The structure to inhibit frost heave according to claim 5 wherein the first skirt panel comprises a first vertical plate, a second vertical plate, a first horizontal plate, and a second horizontal plate;

wherein the first vertical plate, the second vertical plate, the first horizontal plate, and the second horizontal plate are interconnected;

wherein the second skirt panel comprises a third vertical plate, a fourth vertical plate, a third horizontal plate, and a fourth horizontal plate;

wherein the third vertical plate, the fourth vertical plate, the third horizontal plate, and the fourth horizontal plate.

7. The structure to inhibit frost heave according to claim 6 wherein the first vertical plate is a rectangular disk structure;

wherein the second vertical plate is a rectangular disk structure;

wherein the third vertical plate is a rectangular disk structure;

wherein the fourth vertical plate is a rectangular disk structure;

wherein the first horizontal plate is a rectangular disk structure;

wherein the second horizontal plate is a rectangular disk structure;

wherein the third horizontal plate is a rectangular disk structure;

wherein the fourth horizontal plate is a rectangular disk structure.

8. The structure to inhibit frost heave according to claim 7 wherein the form factor of the second vertical plate is identical to the form factor of the first vertical plate;

wherein the form factor of the third vertical plate is identical to the form factor of the second vertical plate;

wherein the form factor of the fourth vertical plate is identical to the form factor of the third vertical plate;

wherein the form factor of the second horizontal plate is identical to the form factor of the first horizontal plate;

wherein the form factor of the third horizontal plate is identical to the form factor of the second horizontal plate;

wherein the form factor of the fourth horizontal plate is identical to the form factor of the third horizontal plate.

9. The structure to inhibit frost heave according to claim 8 wherein the second vertical plate attaches to the first vertical plate such that the second vertical plate projects perpendicularly away from the first vertical plate;

wherein the fourth vertical plate attaches to the first vertical plate such that the fourth vertical plate projects perpendicularly away from the first vertical plate;

wherein the third vertical plate attaches to the second vertical plate such that the third vertical plate projects perpendicularly away from the second vertical plate.

10. The structure to inhibit frost heave according to claim 9 wherein the first horizontal plate rests on the superior surface of the frost pad of the piling;

wherein the second horizontal plate rests on the superior surface of the frost pad of the piling;

wherein the third horizontal plate rests on the superior surface of the frost pad of the piling;

wherein the fourth horizontal plate rests on the superior surface of the frost pad of the piling.

11. The structure to inhibit frost heave according to claim 10 wherein the first horizontal plate attaches to the first vertical plate such that the first horizontal plate projects perpendicularly away from the first vertical plate and the second vertical plate;

wherein the second horizontal plate attaches to the second vertical plate such that the second horizontal plate projects perpendicularly away from the second vertical plate and the first vertical plate;

wherein the third horizontal plate attaches to the third vertical plate such that the third horizontal plate projects perpendicularly away from the third vertical plate and the fourth vertical plate;

wherein the fourth horizontal plate attaches to the fourth vertical plate such that the fourth horizontal plate projects perpendicularly away from the fourth vertical plate and the third vertical plate.

* * * * *